US006283140B1

(12) United States Patent
von Palffy et al.

(10) Patent No.: US 6,283,140 B1
(45) Date of Patent: Sep. 4, 2001

(54) WASTE FLUID DISCHARGE COLUMN

(75) Inventors: Bjorn von Palffy, South Beloit; Douglas M. Wallace, Roscoe, both of IL (US)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/500,406

(22) Filed: Feb. 8, 2000

(51) Int. Cl.[7] ..... F04F 3/00
(52) U.S. Cl. ..... 137/205
(58) Field of Search ..... 137/205

(56) References Cited

U.S. PATENT DOCUMENTS

| | | | | |
|---|---|---|---|---|
| 4,246,925 | | 1/1981 | Oldfelt | 137/205 |
| 4,339,232 | * | 7/1982 | Campbell | 137/205 X |
| 5,575,307 | * | 11/1996 | Martinitz et al. | 137/205 |
| 6,009,892 | * | 1/2000 | Martinitz | 137/205 X |

FOREIGN PATENT DOCUMENTS 8101962-2 9/1982 (SE) .

* cited by examiner

*Primary Examiner*—Gerald A. Michalsky
(74) *Attorney, Agent, or Firm*—Marshall, O'Toole, Gerstein, Murray & Borun

(57) ABSTRACT

A waste fluid discharge column for use in a vacuum drainage system. The discharge column comprises a vertical pipe maintained under negative pressure to create a liquid column inside the vertical pipe. A chamber is attached to an upper end of the pipe and defines a vacuum port and a fluid inlet port. The chamber allows for better separation of waste fluid and air, and provides a vacuum buffer for the drainage system. The present invention further comprises a vacuum drainage system capable of separately handling multiple waste fluid flows. Two or more waste fluid discharge columns may be connected to a single vacuum source. Because the different types of waste fluid are handled separately, treatment and other auxiliary apparatus needed for certain types of waste fluid may be sized properly since the vacuum drainage system may direct only the waste fluid requiring treatment to the auxiliary apparatus.

23 Claims, 2 Drawing Sheets

WASTE FLUID DISCHARGE COLUMN

FIELD OF THE INVENTION

The present invention generally relates to vacuum drainage systems for transporting waste fluid, and more particularly to apparatus for collecting and discharging waste fluid to a municipal or other type of collection point.

BACKGROUND OF THE INVENTION

Vacuum drainage systems are generally known in which a vacuum source is used to transport waste fluid from a waste fluid generating source to a collection tank. In contrast to conventional plumbing, which uses gravity to collect and direct waste fluid, the vacuum source in such vacuum drainage systems creates a pressure differential across a discrete volume of waste fluid (also known as a plug or slug). Conventional vacuum drainage systems typically comprise a collection branch having an intake end open to atmosphere positioned below the waste fluid generating source for receiving the waste fluid. The waste fluid entering through the intake accumulates in a collection area under the force of gravity. A control valve selectively establishes fluid communication between the collection area and the vacuum source, thereby creating the pressure differential. Such systems conventionally have one or more tanks that are maintained under negative pressure by the vacuum source into which the slugs of waste fluid are transported. Additional valving and controls are needed to selectively empty the tanks into a final collection point, such as a municipal sewer system. While such vacuum drainage systems are generally suitable for a wide variety of applications, the collection tanks and associated valving and controls are overly complicated, and add to the expense of such a system.

A more simplified collection and discharge apparatus for use in a vacuum drainage system is described in U.S. patent application Ser. No. 4,246,925 to Oldfelt, which discloses the use of a generally vertical length of pipe having a vacuum source connected to an upper end of the pipe, while the lower end is open to atmosphere. The upper end of the pipe is connected by a conduit to a vacuum pump, while the lower end of the pipe is submerged into a tank that is partially filled with waste fluid. The vacuum pump generates a negative pressure in the vertical pipe, while the tank is maintained at atmospheric pressure. Waste fluid sources, such as toilets and sinks are connected to the vertical pipe by additional conduits, and waste fluid generated by these sources is transferred to the vertical pipe as discrete slugs, as described above. Due to the vacuum in the vertical pipe, the waste fluid is not immediately discharged from the vertical pipe but instead collects inside the pipe to form a liquid column. As the waste fluid accumulates, the liquid column obtains a mass which exceeds the vacuum force in the vertical pipe. Accordingly, waste fluid added to the top of the column beyond the vacuum force capacity causes a corresponding volume of fluid to be discharged from the bottom of the vertical pipe and into the tank. Thus, a substantially constant liquid column height is maintained inside the vertical pipe.

The vertical pipe disclosed in Oldfelt is generally suitable for applications having sufficient vertical clearance to house the vertical pipe. Any waste fluid sources must either be located above the vertical pipe or have runners extending vertically upward to tap into the upper end of the vertical pipe.

In such systems, it is important to prevent waste fluid from flowing into and flooding the vacuum source. Oldfelt discloses the use of a vertical pipe having a substantially uniform diameter, and the vacuum source conduit and waste fluid source conduit intersect the vertical pipe at points which are relatively near one another. Accordingly, a substantial risk exists in the Oldfelt apparatus that the waste fluid will flow into and flood the vacuum source.

It is also desirable for vacuum drainage systems to be capable of separately handling different types of waste fluid. Local plumbing codes often require black water (i.e., polluted liquid from toilets and urinals) to be treated or otherwise handled differently than other types of waste fluid before discharge into a sewer. In a supermarket, for example, various types of waste fluids are generated. Gray water, such as trade waste from meat preparation sinks, must often be directed through treatment apparatus before discharge into the sewer. Other relatively cleaner fluids, such as condensate from refrigerated cases, may often be released directly into the sewer, or may be reused on site to provide, for example, a source of toilet water. Oldfelt fails to disclose a single system capable of separately handling multiple types of waste fluid flows.

SUMMARY OF THE INVENTION

In accordance with certain aspects of the present invention, a vacuum drainage apparatus is provided for collecting and transporting waste fluid from a waste fluid source. The vacuum drainage apparatus comprises a generally vertically oriented pipe having a lower end and an upper end, the pipe having a first cross-sectional area. A chamber is attached to the upper end of the pipe, the chamber defining an inlet port for receiving waste fluid and a vacuum port, the chamber having a second cross-sectional area that is greater than the first cross-sectional area. A vacuum source is provided in fluid communication with the vacuum port of the chamber thereby to generate a vacuum level in the chamber and pipe. A collection branch is in fluid communication with the inlet port of the chamber, the collection branch transporting waste fluid from the waste fluid source to the inlet port of the chamber. The waste fluid flows from the chamber into the pipe, and the vacuum level in the chamber and pipe has a vacuum force which creates a standing column of waste fluid in the pipe. The standing column has a maximum height corresponding to the vacuum force such that a volume of fluid transported to the pipe after the fluid column reaches the maximum height causes an equal volume of fluid to be discharged from the lower end of the pipe.

In accordance with additional aspects of the present invention, fluid discharge apparatus is provided for receiving and discharging waste fluid. The fluid discharge apparatus comprises a generally vertically oriented discharge pipe having a lower end and an upper end, the pipe having a first cross-sectional area. A chamber is attached to the upper end of the pipe and defines an inlet port for receiving waste fluid and a vacuum port, the chamber having a second cross-sectional area greater than the first cross-sectional area. A vacuum source is provided in fluid communication with the vacuum port, the vacuum source generating a vacuum level in the pipe and chamber. The vacuum level in the pipe and chamber has a vacuum force which creates a standing column of waste fluid in the pipe. The standing column has a maximum height corresponding to the vacuum force such that a volume of fluid transported to the pipe after the fluid column reaches the height causes an equal volume of fluid to be discharged from the lower end of the pipe.

According to still further aspects of the present invention, vacuum drainage apparatus is provided for collecting and transporting a first waste fluid and a second waste fluid from first and second waste fluid generating sources, respectively. The vacuum drainage apparatus comprises a vacuum source, and a first discharge column having an upper section comprising a vacuum port in fluid communication with the vacuum source and a waste fluid inlet, and a lower section comprising a waste fluid outlet. A first collection branch is in fluid communication with the waste fluid inlet of the first discharge column, the first collection branch transporting the first waste fluid from the first waste fluid generating source to the waste fluid inlet of the first discharge column. The apparatus further comprises a second discharge column having an upper section comprising a vacuum port in fluid communication with the vacuum source and a waste fluid inlet, and a lower section comprising a waste fluid outlet. A second collection branch is in fluid communication with the waste fluid inlet of the second discharge column, the second collection branch transporting the second waste fluid from the second waste fluid generating source to the waste fluid inlet of the second discharge column.

Other features and advantages are inherent in the apparatus claimed and disclosed or will become apparent to those skilled in the art from the following detailed description and its accompanying drawings.

DETAILED DESCRIPTION OF THE PREFERRED EMBODIMENT

Figures 1, 2:
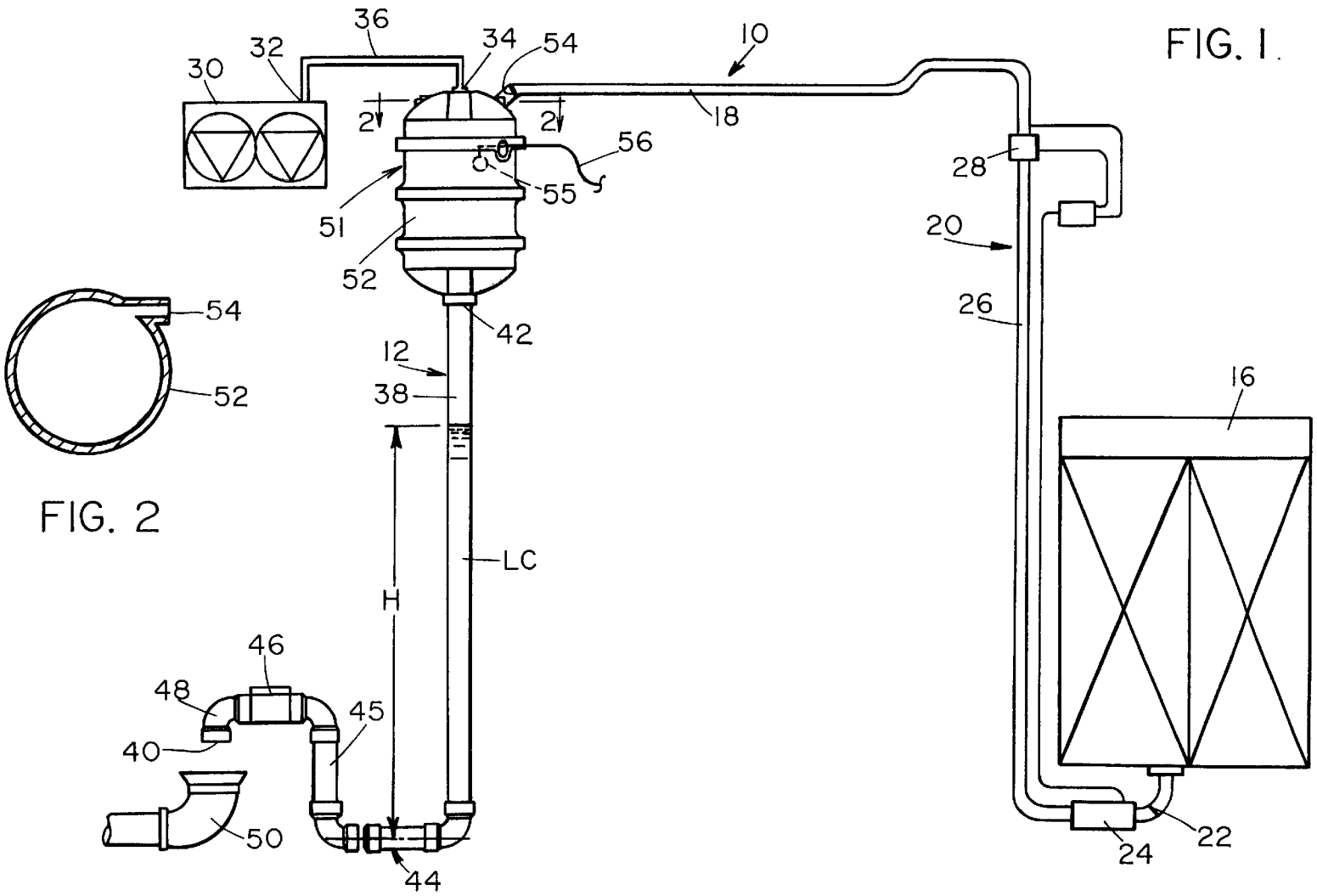
FIG. 1 diagrammatically illustrates a vacuum drainage system incorporating a waste fluid discharge column in accordance with certain aspects of the present invention.
FIG. 2 is a plan view, in cross-section, of a chamber portion of the fluid discharge column taken along line 2—2 of FIG. 1.

A vacuum drainage system 10 incorporating a waste fluid discharge column 12 in accordance with the present invention is illustrated in FIG. 1. For clearness of understanding only, the vacuum drainage system 10 is illustrated in FIG. 1 as collecting waste fluid from a refrigerated case 16 located inside a supermarket. It will be understood, however, that the discharge column 12 described herein is not limited to a particular environment of use or application, but instead may be used in any type of vacuum drainage system which would benefit from the advantages disclosed herein.

According to the embodiment illustrated in FIG. 1, the vacuum drainage system 10 includes a main pipe 18 for transporting waste fluid to the discharge column 12. In the illustrated embodiment, a collection branch 20 is connected to the main pipe 18. It will be appreciated that more than one collection branch 20 for collecting waste fluid from additional apparatus may be connected to the main pipe 18 in accordance with the present invention. The collection branch 20 has an upstream end defining an intake opening 22 positioned below a waste fluid source, such as the refrigerated case 16. A collection area, such as a buffer box 24, is located downstream of the intake opening 22. The buffer box 24 is positioned so that waste fluid passing through the intake opening 22 flows toward the buffer box 24 under the force of gravity. A conduit 26 connects the buffer box 24 to the main pipe 18. A control valve 28 is disposed in the conduit 26 for selectively establishing fluid communication between the intake opening 22 and the main pipe 18.

A vacuum source, such as vacuum pump 30 is provided for generating negative pressure in the vacuum drainage system 10. The vacuum source 30 has an inlet 32 connected to a vacuum port 34 of the discharge column 12 by a conduit 36. The vacuum pump 30 is operable to evacuate air from the vacuum drainage system 10, thereby establishing a negative pressure level in the system.

A lower section of the waste fluid discharge column 12 comprises a generally vertically oriented pipe 38 having a lower end 40 open to atmosphere and an upper end 42 closed off from atmosphere. According to FIG. 1, a lower portion of the pipe 38 is formed with a U-shaped pipe section 44 having a relatively short downstream leg 45 for trapping a volume of waste fluid inside the pipe 38. A check valve 46 is attached to the U-shaped pipe section 44 for preventing back flow of waste fluid into the discharge column 12. In the alternative, the downstream leg 45 of the U-shaped pipe section 44 may be longer, thereby eliminating the need for a check valve. As a further alternative, the U-shaped pipe section 44 may be omitted so that the check valve 46 is attached to the lower end of a straight pipe 38. Returning to the illustrated embodiment, an elbow 48 is attached to the check valve 46 for directing waste fluid into a desired collection point, such as a municipal sewer 50. The pipe 38 and associated fittings are preferably provided in 3–4" diameters to take advantage of available standard fitting sizes and to minimize the cost of the fittings. In addition, the 3–4" diameter pipe and fittings create a relatively small pipe volume, thereby reducing the required capacity of the vacuum source.

In accordance with certain aspects of the present invention, an upper section of the waste fluid discharge column 12 comprises a chamber 51 having a cross-sectional area which is greater than a cross-sectional area of the pipe 38. As illustrated in FIG. 1, the chamber 51 is attached to the upper end 42 of the pipe 38. The vacuum port 34 is formed in the chamber 51 so that the vacuum pump 30 fluidly communicates with the chamber 51. In addition, an inlet port 54 is formed in the chamber 51 for connection to the main pipe 18. Accordingly, it will be appreciated that operation of the vacuum pump 30 generates negative pressure in the chamber 51, vertical pipe 38, and main pipe 18. While, in the preferred embodiment, the chamber 51 is formed as a tank 52 (FIG. 1), it will be understood that the chamber 51 is not limited to a specific component or a particular shape, but instead may be provided in a variety of different forms, as long as at least a portion of the chamber 51 has a larger cross-sectional area than the pipe 38. In fact, the chamber 51 may be formed integrally with the pipe 38 as an increased diameter portion of the pipe.

The vacuum drainage system 10 is operable to transport waste fluid from the waste fluid source to the waste fluid discharge column 12. Waste fluid generated by the refrigerated case 16 is directed to the intake opening 22 of the associated collection branch 20, where the waste fluid flows under the force of gravity to the buffer box 24. The control valve 28 is normally in a closed position, but may be selectively actuated to an open position, thereby establishing fluid communication between the buffer box 24 and the main pipe 18. As a result, negative pressure is present at a downstream side of the buffer box 24 via the conduit 26 while atmospheric pressure is present at an upstream side of the buffer box 24 via the intake opening 22. The resulting pressure differential acts to push the fluid from the buffer box 24 and up the conduit 26 as a discrete volume or slug. The slug of fluid reaches the main pipe where it is either immediately transferred to the discharge column 12 or later transferred by subsequent control valve 28 operations.

Waste fluid from the main pipe 18 enters the tank 52 through the inlet port 54. Any excess air pulled in with the fluid is exhausted by the vacuum pump 30 through the vacuum port 34 of the tank 52. The waste fluid flows through the tank 52 to collect in the vertical pipe 38. The negative pressure in the tank 52 and vertical pipe 38 creates a vacuum force which holds a specific volume of fluid in the vertical pipe 38. Accordingly, waste fluid will collect in the vertical pipe 38 to form a liquid column LC inside the vertical pipe. The height H of the liquid column LC depends primarily upon the negative pressure level generated by the vacuum pump 30 in the vertical pipe 38. For example, when the vacuum pump 30 creates a vacuum level of 10 inches Hg, the liquid column LC will have maximum height H of approximately 11 feet. For a negative pressure level of 20 inches Hg, the liquid column height is approximately 22 feet. Waste fluid will collect inside the vertical pipe 38 until the maximum height is reached. When additional waste fluid is added to the liquid column after it has reached the maximum height H, waste fluid is discharged from the lower end 40 of the pipe 38 until the liquid column lowers back to height H.

During normal operation, the liquid column LC maintains a substantially constant height H, as described above. In certain situations, however, the liquid column LC may temporarily exceed the maximum height H. In high flow conditions, where a greater than normal amount of waste fluid is transported to the vertical pipe 38, the rate of fluid entering the pipe 38 may exceed the rate of fluid discharge out of the pipe 38. Under such conditions, the liquid column LC will temporarily exceed the normal maximum height H until the high flow ceases or slows and the excess fluid is discharged from the pipe 38. The liquid column height during high flow may reach the upper end 42 of the vertical pipe 38 and even enter the chamber 51, thereby creating a risk of flooding the vacuum source. The chamber 51 advantageously increases the fluid carrying capacity of the vertical pipe 38 near the upper end 42, thereby reducing the flood risk.

To further prevent flooding of the vacuum source, an overflow protection device is preferably provided inside the chamber 51 for interrupting power to the vacuum source when the fluid inside the chamber reaches a certain level. In the illustrated embodiment, the overflow protection device is a ball float 55 positioned at a particular height inside the tank 52. The ball float has a lead wire 56 operatively coupled to the vacuum source. The ball float moves in response to an increasing fluid level in the tank 52, thereby sending an overflow signal which interrupts power to the vacuum source. While the illustrated embodiment shows a ball float, it will be appreciated that other overflow protection devices may be used, as long as they are capable of detecting a high fluid level in the tank and actuating in response to the high level to interrupt operation of the vacuum source.

As described above, the discharge column 12 provides inexpensive and less complicated apparatus for discharging waste fluid into a desired collection point without requiring additional valves, controls and other auxiliary devices. The chamber 51, illustrated as the tank 52 in FIG. 1, creates an increased cross-sectional area in which the vacuum port 34 and inlet port 54 are formed. Accordingly, these ports may be spaced farther apart than in a vertical pipe having a uniform diameter, thereby more reliably separating the waste fluid from air. The pipe 38 advantageously has a smaller cross-sectional area to reduce cost and minimize the required vacuum source capacity. To further improve separation, the inlet port 54 may be oriented so that waste fluid is introduced generally tangentially into the tank 52 to minimize the amount of any waste fluid being entrained in the incoming air (FIG. 2). The chamber 51 also increases the total volume of the system, thereby providing a vacuum buffer which helps to maintain the desired vacuum level in the system during operation.

Figure 3:
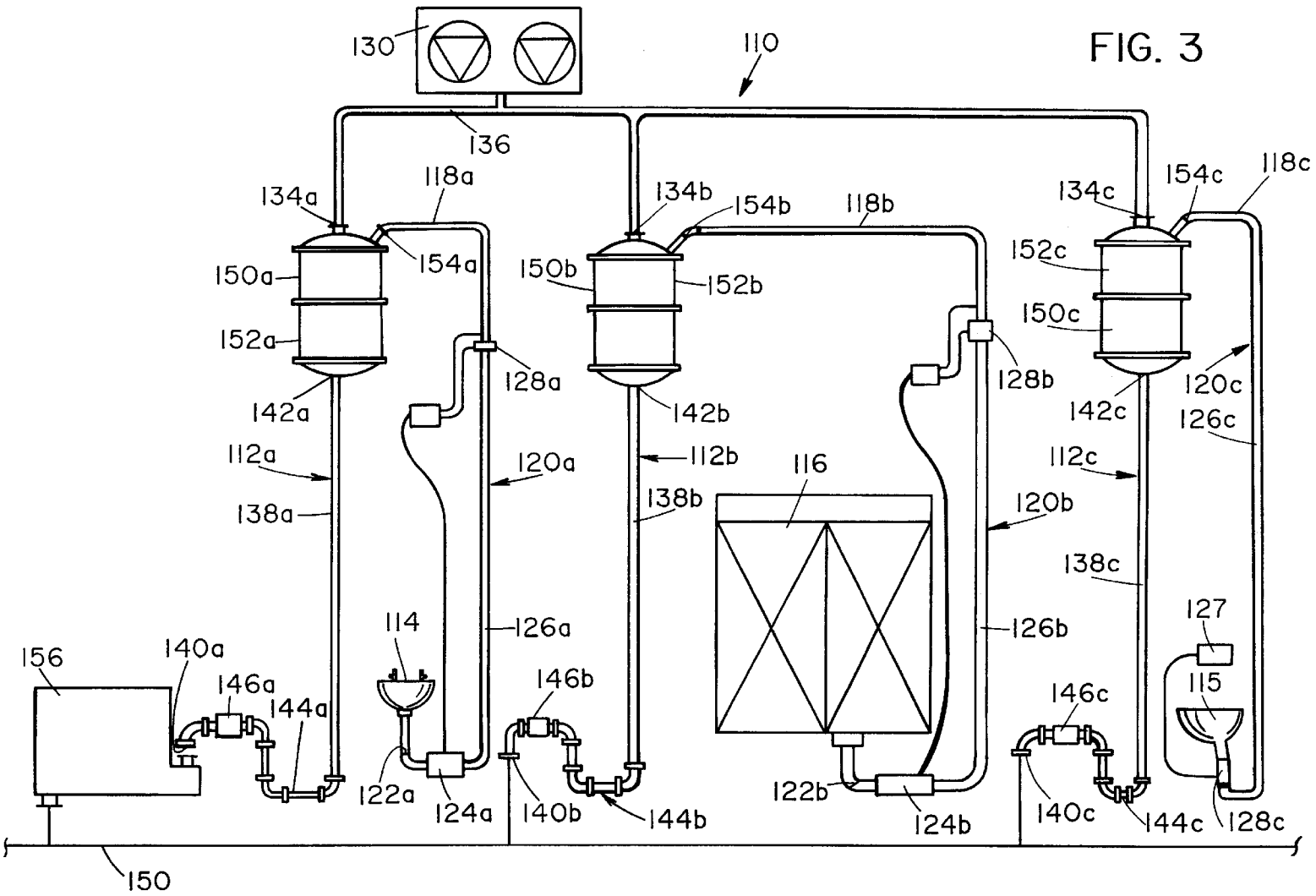
FIG. 3 illustrates a vacuum drainage system capable of handling two different types of waste fluid flows, in accordance with additional aspects of the present invention.

In accordance with additional aspects of the present invention, a vacuum drainage system 110 is provided for handling three different types of waste fluids. As illustrated in FIG. 3, the vacuum drainage system 110 comprises first, second, and third waste fluid discharge columns 112*a*, 112*b*, 112*c*. The vacuum drainage system 110 further includes first, second, and third main pipes 118*a*, 118*b*, 118*c* for transferring waste fluid into the respective discharge columns 112*a*, 112*b*, 112*c*.

A collection branch 120*a* is attached to the main pipe 118*a* and has an intake opening 122*a* for receiving gray water, such as waste fluid from a meat preparation sink 114. The collection branch 120*a* further includes a buffer box 124*a*, a conduit 126*a*, and a control valve 128*a* similar to the system 10 described above.

Similarly, the collection branch 120*b* has an intake opening 122*b*, buffer box 124*b*, conduit 126*b*, and control valve 128*b*. The intake opening 122*b* of the collection branch 120*b*, however, is positioned below a refrigerated case 116 and collects relatively clean condensate.

The collection branch 120*c* transports black water from a toilet 115. The collection branch 120*c* has a conduit 126*c* connected to a control valve 128*c* which, in turn, is connected to an outlet of the toilet 115. A flush control unit 127 actuates the control valve 128*c*.

The first, second, and third waste fluid discharge columns 112*a*, 112*b*, 112*c* each comprise a lower section having a vertically oriented pipe 138*a*, 138*b*, 138*c*. Each vertical pipe 138*a*, 138*b*, 138*c* has a lower end 140*a*, 140*b*, 140*c* open to atmosphere and an upper end 142*a*, 142*b*, 142*c* closed off from atmosphere. A lower portion of each pipe 138*a*, 138*b*, 138*c* is formed with a U-shaped pipe section 144*a*, 144*b*, 144*c*, and a check valve 146*a*, 146*b*, 146*c* is attached to each U-shaped pipe section 144*a*, 144*b*, 144*c*. An upper section of each fluid discharge column 112*a*, 112*b*, 112*c* preferably includes a chamber 150*a*, 150*b*, 150*c* attached to the upper end 142*a*, 142*b*, 142*c* of the respective vertical pipes 138*a*, 138*b*, 138*c*. Each of the chambers 150*a*, 150*b*, 150*c* have a cross-sectional area which is larger than that of the respective pipe 138*a*, 138*b*, 138*c*. In the illustrated embodiment, each chamber 150*a*, 150*b*, 150*c* is provided as a hollow tank 152*a*, 152*b*, 152*c* having a vacuum port 134*a*, 134*b*, 134*c* and an inlet port 154*a*, 154*b*, 154*c*. Inlet port 154*a* is attached to main pipe 118*a*, inlet port 154*b* is attached to main pipe 118*b*, and inlet port 154*c* is attached to main pipe 118*c*. The vacuum ports 134*a*, 134*b*, 134*c* are attached by a common conduit 136 to a vacuum source, such as vacuum pump 130. The vacuum pump 130 operates to create a negative pressure in the tanks 152*a*, 152*b*, 152*c*, waste fluid discharge columns 112*a*, 112*b*, 112*c*, and main pipes 118*a*, 118*b*, 118*c*.

In operation, the vacuum drainage system 110 operates in a similar manner as the vacuum drainage system 10 of the first embodiment described above. The intake opening 122*a* of the collection branch 120*a*, for example, receives a first waste fluid from the meat preparation sink 114. The first waste fluid passes through the intake opening 122*a* to collect in the buffer box 124*a*. The control valve 128*a* is temporarily opened to create a pressure differential across the fluid collected in the buffer box 124*a*, thereby transporting the fluid through the conduit 126*a* as a discrete volume. The waste fluid is transported through the main pipe 118*a* to the tank 152*a*, which subsequently empties into the vertical pipe 138*a*. As with the previous embodiment, the negative pressure level in the vertical pipe 138*a* holds a predetermined volume of fluid inside the pipe as a liquid column. Once the liquid column reaches its maximum height, additional fluid added to the top of the column causes an equal amount of fluid to discharge out of the lower end 140*a* of the pipe 138*a*.

The collection branch 120*b* and waste fluid discharge column 112*b* operate in the same manner. The collection branch 120*b*, however, collects a second waste fluid which is different from the first waste fluid. In the illustrated embodiment, the second waste fluid comprises relatively clean condensate from the refrigerated case 116.

The collection branch 120*c*, which collects black water from the toilet 115, operates in a slightly different manner, while the waste fluid discharge column 112*c* operates as described above. The flush control unit 127 is responsive to a flush command to open the control valve 128*c*. When the control valve 128*c* is open, atmospheric pressure present inside the bowl of the toilet 115 pushes the third waste fluid through the conduit 126*c* and into the waste fluid discharge column 112*c*

While the embodiment illustrated in FIG. 3 shows three discharge columns, each having one associated collection branch, it will be appreciated that only two or more than three discharge columns may be used, and each discharge column may have one or more associated collection branch, in accordance with the present invention. Furthermore, while each collection branch 120*a*, 120*b*, 120*c* is shown receiving waste fluid from a single source, it will be appreciated that each collection branch may serve two or more waste fluid sources as needed for a particular application.

Fluid treatment apparatus 156 may be provided for treating waste fluid prior to discharge into a collection point, such as a community sewer 158. As shown in FIG. 3, the first waste fluid generated by the meat preparation sink 114 and collected in the discharge column 112*a* is discharged from the lower end 140*a* of the vertical pipe 138*a* into an inlet of the fluid treatment apparatus 156, such as a grease trap. The grease trap removes grease from the first waste fluid so that it is suitable for discharge into the municipal sewer 158. Because the first fluid is handled separately, only the fluid requiring treatment is directed through the treatment apparatus.

The second waste fluid, described herein as condensate, is relatively clean and therefore does not require treatment. Accordingly, as shown in FIG. 3, the second waste fluid is discharged directly from the waste fluid discharge column 112*b* into the sewer 158. In the alternative, the second waste fluid may be reused on site, such as by providing a supply of toilet water.

The third waste fluid, described above as black water, is also discharged directly into the sewer 158. The system 110 handles this fluid stream separately, since local code may restrict the location of piping used to transport black water.

In view of the foregoing, it will be appreciated that the present invention brings to the art a new and improved waste fluid discharge column for use in a vacuum drainage system. The discharge column comprises a lower section having vertical pipe and an upper section having a chamber. The chamber allows for better separation of waste fluid and air, and provides a vacuum buffer for the drainage system. In addition, two or more waste fluid discharge columns may be connected to a single vacuum source to provide for separate handling of different types of waste fluids. While certain types of waste fluid may be directly discharged into a sewer, other types of waste fluid must first be treated, while still other types of waste fluid are more stringently governed by local code. Because the different types of waste fluid are handled separately, treatment and other auxiliary apparatus may be sized properly since the vacuum drainage system may direct only the waste fluid requiring treatment to the auxiliary apparatus. The discharge column of the present invention provides inexpensive and reliable apparatus for discharging waste fluid from a vacuum drainage system.

The foregoing detailed description has been given for clearness of understanding only, and no unnecessary limitations should be understood therefrom, as modifications would be obvious to those skilled in the art.

What is claimed is:

1. Vacuum drainage apparatus for collecting and transporting waste fluid from a waste fluid source, the vacuum drainage apparatus comprising:

a generally vertically oriented pipe having a lower end and an upper end, the pipe having a first cross-sectional area;

a chamber attached to the upper end of the pipe, the chamber defining an inlet port for receiving waste fluid and a vacuum port, the chamber having a second cross-sectional area that is greater than the first cross-sectional area;

a vacuum source in fluid communication with the vacuum port of the chamber thereby to generate a vacuum level in the chamber and pipe; and a collection branch in fluid communication with the inlet port of the chamber, the collection branch transporting waste fluid from the waste fluid source and air to the inlet port of the chamber, the waste fluid flowing from the chamber into the pipe while the air is evacuated by the vacuum source through the vacuum port, the vacuum level in the chamber and pipe having a vacuum force which creates a standing column of waste fluid in the pipe, the standing column having a maximum height corresponding to the vacuum force such that a volume of fluid transported to the pipe after the fluid column reaches the maximum height causes an equal volume of fluid to be discharged from the lower end of the pipe;

wherein the vacuum port and inlet port are spaced to separate the air from the waste fluid.

2. The vacuum drainage apparatus of claim 1, in which the chamber comprises a tank.

3. The vacuum drainage apparatus of claim 1, in which a lower portion of the pipe comprises a U-shaped pipe section.

4. The vacuum drainage apparatus of claim 3, further comprising a check valve attached to a downstream end of the U-shaped pipe section.

5. The vacuum drainage apparatus of claim 1, in which the vertical pipe is cylindrical, and has an inside diameter of approximately 3–4 inches.

6. The vacuum drainage apparatus of claim 1, in which the collection branch comprises an intake end open to atmosphere for receiving the waste fluid, a collection area for accumulating a volume of waste fluid under gravity, and a control valve for selectively establishing fluid communication between the intake end and the inlet port of the discharge pipe, whereby a pressure differential transports the volume of fluid in the collection area to the discharge pipe when the control valve is open.

7. Fluid discharge apparatus for receiving and discharging waste fluid and air, the fluid discharge apparatus comprising:

a generally vertically oriented discharge pipe having a lower end and an upper end, the pipe having a first cross-sectional area;

a chamber having a second cross-sectional area greater than the first cross-sectional area attached to the upper end of the pipe and defining an inlet port for receiving the waste fluid and air, and a vacuum port, the waste fluid flowing into the pipe; and a vacuum source in fluid communication with the vacuum port, the vacuum source evacuating the air and generating a vacuum level in the pipe and chamber having a vacuum force which creates a standing column of waste fluid in the pipe, the standing column having a maximum height corresponding to the vacuum force such that a volume of fluid transported to the pipe after the fluid column reaches the height causes an equal volume of fluid to be discharged from the lower end of the pipe;

wherein the vacuum port and inlet port are spaced to separate the air from the waste fluid.

8. The fluid discharge apparatus of claim 7, in which the chamber comprises a tank.

9. The fluid discharge apparatus of claim 7, in which a lower portion of the pipe comprises a U-shaped pipe section.

10. The fluid discharge apparatus of claim 9, further comprising a check valve attached to a downstream end of the U-shaped pipe section.

11. The fluid discharge apparatus of claim 7, in which the vertical pipe is cylindrical, and has an inside diameter of approximately 3–4 inches.

12. The fluid discharge apparatus of claim 7, further comprising a collection branch having an intake end open to atmosphere for receiving the waste fluid, a collection area for accumulating a volume of waste fluid under gravity, and a control valve for selectively establishing fluid communication between the intake end and the inlet port of the discharge pipe, whereby a pressure differential transports the volume of fluid in the collection area to the discharge pipe when the control valve is open.

13. Vacuum drainage apparatus for collecting and transporting a first waste fluid and a second waste fluid from first and second waste fluid generating sources, respectively, the vacuum drainage apparatus comprising:

a vacuum source;

a first, generally vertically oriented discharge column having an upper section comprising a vacuum port in fluid communication with the vacuum source and a waste fluid inlet, and a lower section comprising a waste fluid outlet open to atmosphere;

a first collection branch in fluid communication with the waste fluid inlet of the first discharge column, the first collection branch transporting the first waste fluid from the first waste fluid generating source to the waste fluid inlet of the first discharge column, the vacuum source producing a vacuum force in the first discharge column which creates a standing column of first waste fluid in the first discharge column, the standing column having a maximum height corresponding to the vacuum force such that a volume of first waste fluid transported to the first discharge column after the fluid column reaches the maximum height causes an equal volume of first waste fluid to be discharged from the waste fluid outlet of the first discharge column;

a second, generally vertically oriented discharge column having an upper section comprising a vacuum port in fluid communication with the vacuum source and a waste fluid inlet, and a lower section comprising a waste fluid outlet open to atmosphere;

a second collection branch in fluid communication with the waste fluid inlet of the second discharge column, the second collection branch transporting the second waste fluid from the second waste fluid generating source to the waste fluid inlet of the second discharge column, the vacuum source producing a vacuum force in the second discharge column which creates a standing column of second waste fluid in the second discharge column, the standing column having a maximum height corresponding to the vacuum force such that a volume of second waste fluid transported to the second discharge column after the fluid column reaches the maximum height causes an equal volume of second waste fluid to be discharge from the waste fluid outlet of the first discharge column.

14. The vacuum drainage apparatus of claim 13, in which each lower section of the first and second discharge columns comprises a vertical pipe having a first cross-sectional area, and in which each upper section of the first and second discharge columns comprises a chamber having a second cross-sectional area greater than the first cross-sectional area.

15. The vacuum drainage apparatus of claim 14, in which each chamber of the first and second discharge columns comprises a tank.

16. The vacuum drainage apparatus of claim 14, in which each vertical pipe of the first and second discharge columns is cylindrical, and has an inside diameter of approximately 3–4 inches.

17. The vacuum drainage apparatus of claim 14, in which each vertical pipe of the first and second discharge columns has a lower portion comprising a U-shaped pipe section.

18. The vacuum drainage apparatus of claim 17, further comprising a check valve attached to a downstream end of each U-shaped pipe section.

19. The vacuum drainage apparatus of claim 13, in which the first waste fluid comprises condensate, and in which the waste fluid outlet of the first discharge column discharges the condensate directly into a sewer line.

20. The vacuum drainage apparatus of claim 13, in which the second waste fluid comprises gray water, and in which the waste fluid outlet of the second discharge column discharges the gray water into an inlet of a treatment unit, the treatment unit having an outlet in fluid communication with a sewer line.

21. The vacuum drainage apparatus of claim 13, which the first collection branch comprises an intake end open to atmosphere for receiving the first waste fluid, a collection area for accumulating a volume of the first waste fluid under gravity, and a control valve for selectively establishing fluid communication between the intake end and the waste fluid inlet of the first discharge column, wherein a pressure differential transports the volume of first waste fluid from the collection area to the first discharge column when the control valve is open, and in which the second collection branch comprises an intake end open to atmosphere for receiving the second waste fluid, a collection area for accumulating a volume of the second waste fluid under gravity, and a control valve for selectively establishing fluid communication between the intake end and the waste fluid inlet of the second discharge column, wherein a pressure differential transports the volume of second waste fluid from the collection area to the second discharge column when the control valve is open.

22. The vacuum drainage apparatus of claim 13, further comprising a third discharge column having an upper section comprising a vacuum port in fluid communication with the vacuum source and a waste fluid inlet, and a lower section comprising a waste fluid outlet, and a third collection branch in fluid communication with the waste fluid inlet of the third discharge column, the third collection branch transporting a third waste fluid from a third waste fluid generating source to the waste fluid inlet of the third discharge column.

23. The vacuum drainage apparatus of claim 22, in which the third waste fluid comprises black water, and in which the waste fluid outlet of the third discharge column discharges the black water directly into a sewer line.

* * * * *